US010473353B2

(12) United States Patent
Tani et al.

(10) Patent No.: US 10,473,353 B2
(45) Date of Patent: Nov. 12, 2019

(54) AIR CONDITIONER AND DEFROSTING OPERATION METHOD THEREFOR

(71) Applicant: Johnson Controls-Hitachi Air Conditioning Technology (Hong Kong) Limited, Hong Kong (CN)

(72) Inventors: Kazuhiko Tani, Tokyo (JP); Koji Naito, Tokyo (JP); Tatsuya Mochida, Tokyo (JP); Kazumoto Urata, Tokyo (JP); Yoshiyuki Akiyama, Tokyo (JP); Masami Inaba, Tokyo (JP)

(73) Assignee: Hitachi-Johnson Controls Air Conditioning, Inc., Tokyo (JP)

( * ) Notice: Subject to any disclaimer, the term of this patent is extended or adjusted under 35 U.S.C. 154(b) by 244 days.

(21) Appl. No.: 15/305,110

(22) PCT Filed: Apr. 22, 2014

(86) PCT No.: PCT/JP2014/061311

§ 371 (c)(1),
(2) Date: Oct. 19, 2016

(87) PCT Pub. No.: WO2015/162696

PCT Pub. Date: Oct. 29, 2015

(65) Prior Publication Data

US 2017/0038125 A1 Feb. 9, 2017

(51) Int. Cl.
*F25B 47/02* (2006.01)
*F24F 11/89* (2018.01)
(Continued)

(52) U.S. Cl.
CPC ..... *F24F 11/89* (2018.01); *F25B 47/022* (2013.01); *F25B 47/025* (2013.01); *F25B 49/02* (2013.01);
(Continued)

(58) Field of Classification Search
CPC .. F25B 47/025; F25B 47/021; F25B 2700/15; F25B 2347/021
See application file for complete search history.

(56) References Cited

U.S. PATENT DOCUMENTS 6,012,294 A 1/2000 Utsumi

FOREIGN PATENT DOCUMENTS

CN 1222662 A 7/1999
JP 63-213765 A 9/1988
(Continued)

OTHER PUBLICATIONS

English Translation of JPH0799298 (Year: 1995).*
(Continued)

*Primary Examiner* — David J Teitelbaum
(74) *Attorney, Agent, or Firm* — Mattingly & Malur, PC

(57) ABSTRACT

A hot gas bypass circuit that connects a discharge side of the compressor and a portion between the heat source side heat exchanger and the expansion valve, an on-off valve that opens and closes a channel of the hot gas bypass circuit, and a control device performing control to select one of hot gas bypass defrosting and reverse cycle defrosting according to a frosting amount on the heat source side heat exchanger and perform defrosting. The control device controls to open the on-off valve of the hot gas bypass circuit such that a part of a refrigerant discharged from the compressor is supplied to the heat source side heat exchanger via the hot gas bypass circuit and, the control device switches switch the four-way valve such that the refrigerant discharged from the compressor is supplied to the heat source side heat exchanger after passing through the four-way valve.

6 Claims, 6 Drawing Sheets

(51) Int. Cl.
*F25B 49/02* (2006.01)
*F25B 41/04* (2006.01)

(52) U.S. Cl.
CPC ..... *F25B 41/04* (2013.01); *F25B 2313/0294* (2013.01); *F25B 2347/021* (2013.01); *F25B 2700/11* (2013.01); *F25B 2700/15* (2013.01); *F25B 2700/1933* (2013.01); *F25B 2700/2117* (2013.01)

(56) References Cited

FOREIGN PATENT DOCUMENTS

| | | | | |
|---|---|---|---|---|
| JP | 64-33481 | A | 2/1989 | |
| JP | 6-79732 | A | 3/1993 | |
| JP | 7-243728 | A | 9/1995 | |
| JP | H0799298 | * | 10/1995 | ..... F25B 47/02 |
| JP | 10-103818 | A | 4/1998 | |
| JP | 11-287538 | A | 10/1999 | |
| JP | 2002-107014 | A | 4/2002 | |
| JP | 2007-51805 | A | 3/2007 | |
| JP | 2007-225158 | A | 9/2007 | |
| JP | 2008-096033 | A | 4/2008 | |
| JP | 2009-243756 | A | 10/2009 | |
| JP | 2010-032107 | A | 2/2010 | |
| JP | 2011-144960 | A | 7/2011 | |
| KR | 100270723 | B1 | 11/2000 | |
| KR | 100361907 | B1 | 11/2002 | |

OTHER PUBLICATIONS

Extended European Search Report received in corresponding European Application No. 14889943.8 dated Oct. 24, 2017.
Japanese Office Action received in corresponding Japanese Application No. 2016-514587 dated Jul. 3, 2018.
International Search Report of PCT/JP2014/061311 dated Jul. 22, 2014.
Chinese Office Action received in corresponding Chinese Application No. 201480078206.4 dated Nov. 16, 2018.
Chinese Office Action received in corresponding Chinese Application No. 201480078206.4 dated May 17, 2019.
Hongjun, L. et al., "Experiments on Defrosting Control Based on Exhaust Fan Current Combined with Evaporation Temperature", Mar. 15, 2007, pp. 116-119.

* cited by examiner

AIR CONDITIONER AND DEFROSTING OPERATION METHOD THEREFOR

TECHNICAL FIELD

The present invention relates to an air conditioner that performs defrosting operation and a defrosting operation method for the air conditioner.

BACKGROUND ART

When a heat pump type air conditioner is operated for heating, frost is sometimes deposited on the surface of an outdoor heat exchanger (a heat source side heat exchanger). When the frost closes an air duct between fins in the outdoor heat exchanger, heat exchange performance of the outdoor heat exchanger is deteriorated and a sufficient heating capacity cannot be obtained. Therefore, it is necessary to periodically determine a frosting state of the outdoor heat exchanger and remove the frost.

As a method of removing the frost, there have been known a reverse cycle defrosting operation for switching a four-way valve to a cooling operation side to remove the frost and a hot gas bypass defrosting operation for providing a hot gas bypass circuit bypassed from a compressor discharge side and including an on-off valve, connecting the circuit to an outdoor heat exchanger inlet side, and feeding a part of a compressor discharge gas refrigerant to an outdoor heat exchanger to remove the frost.

As a conventional technique for switching the hot gas bypass defrosting operation and the reverse cycle defrosting operation to perform defrosting operation, for example, there is a technique described in Patent Literature 1 (JP-A-2008-96033). Patent Literature 1 describes an invention for, when detecting frosting on an outdoor heat exchanger, switching a four-way valve to perform the reverse cycle defrosting operation and, when a pipe heat storage amount serving as a defrosting heat source detected by heat-storage-amount detecting means is equal to or smaller than a set value, switching the four-way valve to a regular cycle side and opening a hot gas bypass on-off valve to perform the hot gas bypass defrosting operation.

As another conventional technique, there is a technique described in Patent Literature 2 (JP-A-2011-144960). Patent Literature 2 describes an invention for, in an air conditioner including two defrosting operation systems of defrosting operation of a hot gas bypass system and defrosting operation of a reverse (reverse cycle) system, carrying out defrosting by the reverse system when the number of revolutions of a compressor is equal to or larger than a predetermined number of revolutions and increasing the number of revolutions of the compressor and performing the defrosting operation according to the hot gas bypass system when the number of revolutions of the compressor is smaller than the predetermined number of revolutions.

CITATION LIST

Patent Literature

Patent Literature 1: JP-A-2008-96033
Patent Literature 2: JP-A-2011-144960

SUMMARY OF INVENTION

Technical Problem

In the hot gas bypass defrosting operation, it is possible to simultaneously perform heating operation and defrosting operation by bypassing the refrigerant discharged from the compressor. Since the four-way valve is not switched and a freezing cycle is not switched to a reverse cycle, it is possible to accelerate a rise in a room temperature after the defrosting.

However, in the hot gas bypass defrosting operation, since energy of the bypassed refrigerant is used for the defrosting, a heating capacity decreases. When a frosting amount is large, the defrosting operation is long compared with the reverse cycle defrosting system. Therefore, there is a problem in that a total heating capacity during air conditioner operation decreases when the frosting amount is large compared with the reverse cycle defrosting system.

In the reverse cycle defrosting operation, since a flow of the refrigerant is switched to a cooling side to feed the refrigerant having high temperature to the outdoor heat exchanger acting as an evaporator, a high defrosting capacity is obtained. Therefore, when the frosting mount is large, compared with the hot gas bypass defrosting operation, it is possible to complete the defrosting operation in a short time in the reverse cycle defrosting operation. If the defrosting operation can be ended in a short time, it is possible to secure a long heating operation time. Therefore, it is possible to suppress the decrease in the total heating capacity during the air conditioner operation.

However, when the reverse cycle defrosting operation is performed, it is necessary to switch the freezing cycle from the regular cycle to the reverse cycle. When the freezing cycle is switched to the reverse cycle, the heating operation is suspended. Since an indoor heat exchanger acts as an evaporator during the defrosting operation, temperature drops and a room temperature drop increases. The temperature of a refrigerant pipe connected to the indoor heat exchanger also drops. Therefore, even if the defrosting operation is ended to start the heating operation, time required for startup of the heating operation is longer than the time in the case of the hot gas bypass defrosting operation. Therefore, there is a problem in that, when the frosting amount is small, in the reverse cycle defrosting operation, a total of a defrosting operation time and time required for a room temperature rise after the defrosting is long compared with when the hot gas bypass defrosting operation is performed.

An object of the present invention is to obtain an air conditioner and a defrosting operation method for the air conditioner that can reduce time for defrosting, which is a total of times required for defrosting operation and heating operation startup after the defrosting operation, to thereby suppress a decrease in a total heating capacity during air conditioner operation.

Solution to Problem

In order to achieve the object, according to an aspect of the present invention, there is provided an air conditioner in which a compressor, a four-way valve, a use side heat exchanger, an expansion valve, and a heat source side heat exchanger are connected to configure a freezing cycle. The air conditioner includes: a hot gas bypass circuit that connects a discharge side of the compressor and a portion between the heat source side heat exchanger and the expansion valve; an on-off valve that opens and closes a channel of the hot gas bypass circuit; and a control device that performs control to select one of hot gas bypass defrosting operation and reverse cycle defrosting operation according to a frosting amount on the heat source side heat exchanger and perform defrosting operation. When executing the hot gas bypass defrosting operation, the control device performs control to open the on-off valve of the hot gas bypass circuit such that a part of a refrigerant discharged from the compressor is supplied to the heat source side heat exchanger via the hot gas bypass circuit and, when executing the reverse cycle defrosting operation, the control device performs operation to switch the four-way valve such that the refrigerant discharged from the compressor is supplied to the heat source side heat exchanger after passing through the four-way valve.

According to another aspect of the present invention, there is provided a defrosting operation method for an air conditioner including a heat source side heat exchanger and configured to be capable of performing defrosting operation for frost deposited on the heat source side heat exchanger. The air conditioner is configured to be capable of carrying out both of hot gas bypass defrosting operation and reverse cycle defrosting operation. The defrosting operation method includes: detecting a frosting amount on the heat source side heat exchanger; and selecting one of the hot gas bypass defrosting operation or the reverse cycle defrosting operation to carry out defrosting operation according to the detected frosting amount on the heat source side heat exchanger.

Advantageous Effect of Invention

According to the present invention, there is an effect that it is possible to obtain an air conditioner and a defrosting operation method for the air conditioner that can reduce time for defrosting, which is a total of times required for defrosting operation and heating operation startup after the defrosting operation, to thereby suppress a decrease in a total heating capacity during air conditioner operation.

DESCRIPTION OF EMBODIMENTS

Figure 1:
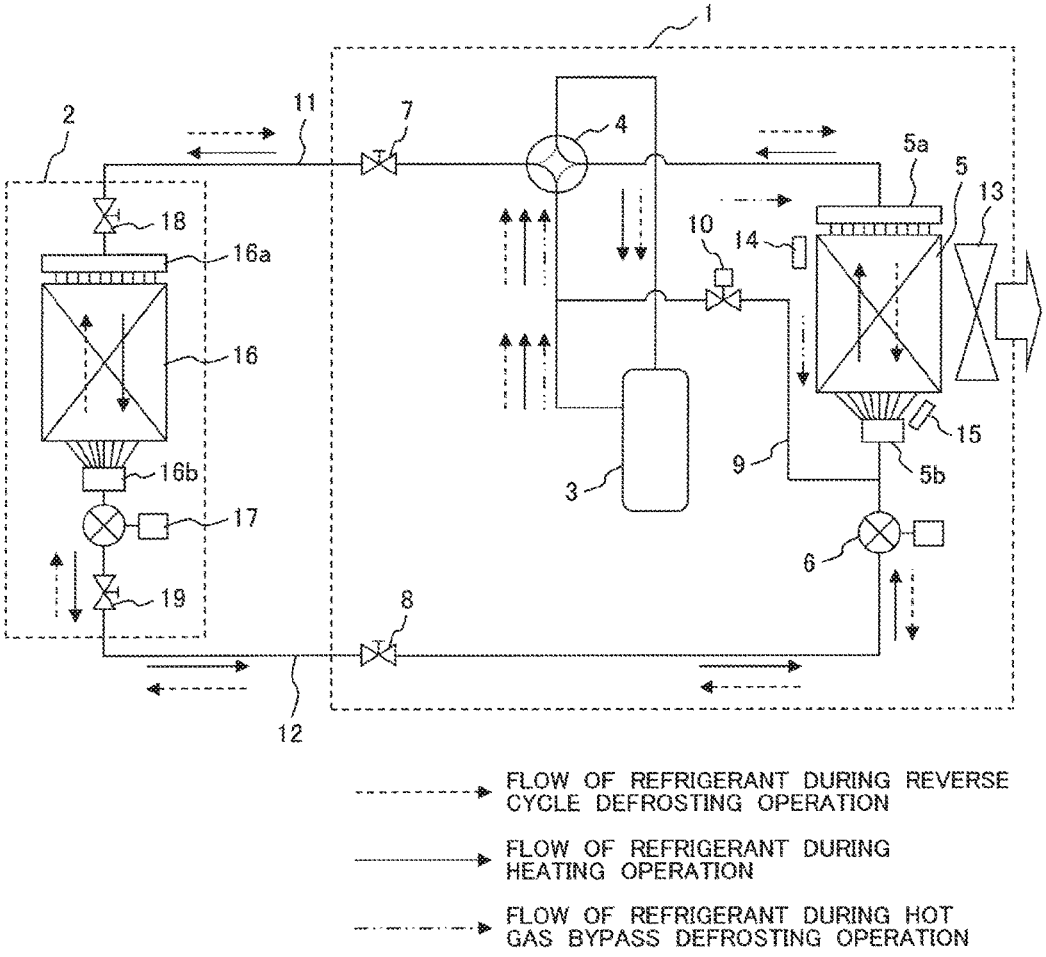
FIG. 1 is a freezing cycle configuration diagram (a refrigerant circuit diagram) showing a first embodiment of an air conditioner of the present invention.

Specific embodiments of an air conditioner and a defrosting operation method for the air conditioner of the present invention are explained with reference to the drawings. Note that, in the figures, portions denoted by the same reference numerals and signs denote the same or equivalent portions.

First Embodiment

Figure 2:
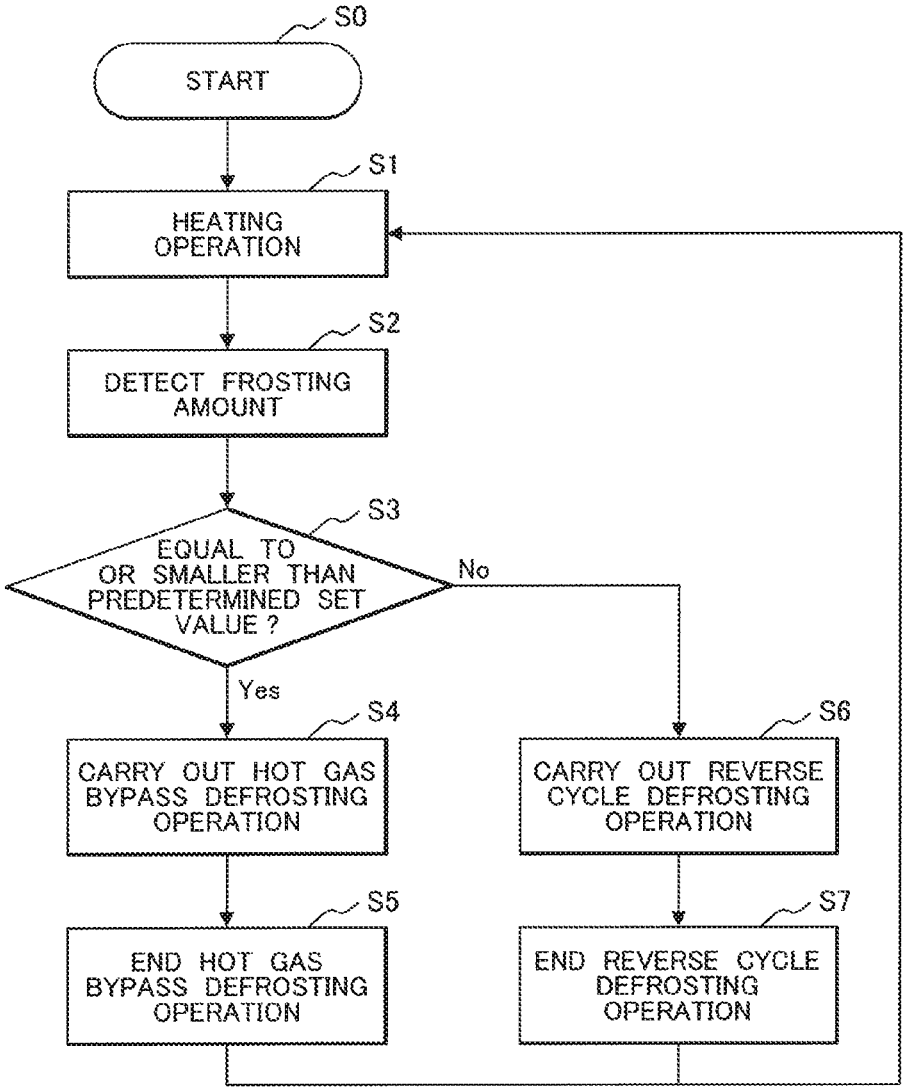
FIG. 2 is a flowchart showing operation for controlling defrosting operation in the first embodiment.

A first embodiment of the present invention is explained with reference to FIG. 1 and FIG. 2. FIG. 1 is a freezing cycle configuration diagram (a refrigerant circuit diagram) showing a first embodiment of an air conditioner of the present invention. FIG. 2 is a flowchart showing operation for controlling defrosting operation in the first embodiment.

First, the configuration of the air conditioner in the first embodiment is explained with reference to FIG. 1.

The air conditioner is configured by an outdoor machine (an outdoor unit) 1 and an indoor machine (an indoor unit) 2 connected to the outdoor machine 1 by refrigerant pipes 11 and 12 (11: a gas pipe, 12: a liquid pipe).

The outdoor machine 1 is configured by a compressor 3 configured by a scroll compressor or the like, a four-way valve 4, an outdoor heat exchanger (a heat source side heat exchanger) 5, an outdoor expansion valve 6 configured by an electronic expansion valve, a throttle opening of which is variable, and the like, an outdoor machine side gas prevention valve 7 connected to the gas pipe 11 side, an outdoor machine side liquid prevention valve 8 connected to the liquid pipe 12 side, and the like. A gas header (a gas branch pipe) 5*a* and a liquid header (a liquid branch pipe) 5*b* are provided in the outdoor heat exchanger 5.

Reference numeral 9 denotes a hot gas bypass circuit that connects a refrigerant pipe between a discharge side of the compressor 3 and the four-way valve 4 and a refrigerant pipe between the outdoor heat exchanger 5 and the outdoor expansion valve 6. A hot gas bypass on-off valve (an on-off valve) 10 is provided in the hot gas bypass circuit 9. A channel of the hot gas bypass circuit 9 is opened and closed by the hot gas bypass on-off valve 10, whereby hot gas bypass defrosting operation can be executed.

Reference numeral 13 denotes an outdoor blower for blowing outdoor air to the outdoor heat exchanger 5 as indicated by a white arrow in the figure to cause the outdoor air and a refrigerant flowing in a heat transfer pipe (a refrigerant pipe) in the outdoor heat exchanger 5 to exchange heat. Reference numeral 14 denotes an outdoor air temperature thermistor provided on an air (outdoor air) suction side near the outdoor heat exchanger 5 and for detecting an outdoor air temperature (an air temperature). Reference numeral 15 denotes a heat exchanger temperature thermistor that detects the temperature of the refrigerant pipe between the outdoor heat exchanger 5 and the liquid header 5*b* of the outdoor heat exchanger 5. The heat exchanger temperature thermistor 15 is a thermistor for detecting the temperature of the outdoor heat exchanger 5. The heat exchanger temperature thermistor 15 only has to be provided in a portion where the temperature of the outdoor heat exchanger 5 can be measured. For example, by providing the heat exchanger temperature thermistor 15 in a portion with a large number of liquid phases (the liquid header 5*b* side) of the outdoor heat exchanger 5, it is possible to more stably measure the heat exchanger temperature than when the heat exchanger temperature thermistor 15 is provided on the gas header 5*a* side.

The indoor machine 2 is configured by an indoor heat exchanger (a use side heat exchanger) 16, an indoor expansion valve 17 configured by an electronic expansion valve, a throttle opening of which is variable, or the like, an indoor machine side gas prevention valve 18 connected to the gas pipe 11 side, an indoor machine side liquid prevention valve 19 connected to the liquid pipe 12 side, and the like. A gas header (a gas branch pipe) 16*a* and a liquid header (a liquid branch pipe) 16*b* are also provided in the outdoor heat exchanger 16.

The outdoor machine 1 and the indoor machine 2 are connected by the refrigerant pipes 11 and 12, whereby the compressor 3, the four-way valve 4, the outdoor heat exchanger 5, the outdoor expansion valve 6, the indoor expansion valve 17, and the indoor heat exchanger 16 are sequentially connected by the refrigerant pipe to configure a freezing cycle.

The four-way valve 4 is a valve for switching a direction of a flow of the refrigerant. During the heating operation, the four-way valve 4 switches the refrigerant circuit to connect the discharge side of the compressor 3 and the indoor heat exchanger 16 and connect the suction side of the compressor 3 and the outdoor heat exchanger 5.

During the cooling operation and during the reverse cycle defrosting operation, the four-way valve 4 switches the refrigerant channel to connect the discharge side of the compressor 3 and the outdoor heat exchanger 5 and connect the suction side of the compressor 3 and the indoor heat exchanger 16.

The outdoor heat exchanger 5 is configured by, for example, a fin-and-tube type heat exchanger of a cross fin type configured by a heat transfer pipe and a large number of fins provided to cross the heat transfer pipe. A gas side of the outdoor heat exchanger 5 is connected to the four-way valve 4 and a liquid side of the outdoor heat exchanger 5 is connected to the outdoor expansion valve 6. The outdoor heat exchanger 5 functions as a condenser for the refrigerant during the cooling operation and functions as an evaporator for the refrigerant during the heating operation.

The indoor heat exchanger 16 is also configured by, for example, a fin-and-tube type heat exchanger of the cross fin type configured by a heat transfer pipe and a larger number of fins. The indoor heat exchanger 16 functions as an evaporator for the refrigerant during the cooling operation and cools the air in a room. The indoor heat exchanger 16 functions as a condenser for the refrigerant during the heating operation and heats the air in the room.

The outdoor expansion valve 6 and the indoor expansion valve 17 are disposed in the refrigerant pipe between the outdoor heat exchanger 5 and the indoor heat exchanger 16. The outdoor expansion valve 6 and the indoor expansion valve 17 adjust the throttle openings thereof to thereby perform, for example, adjustment of a flow rate of the refrigerant flowing to the refrigerant circuit.

The air conditioner is configured to be capable of performing the hot gas bypass defrosting operation and the reverse cycle defrosting operation in order to melt and remove frost deposited on the outdoor heat exchanger 5. In this embodiment, the air conditioner is controlled by a control device (not shown in the figure) to detect or estimate a frosting amount on the outdoor heat exchanger 5 and perform the hot gas bypass defrosting operation when the frosting amount is relatively small and carry out the reverse cycle defrosting operation when the frosting amount is large.

For example, if a ratio of an area of frosting (hereinafter referred to as frosted area) is less than 20 to 30% with respect to a heat transfer area in the outdoor heat exchanger 5, the air conditioner determines that frosting is little and continues the heating operation. If the ratio is 20 to 30% or more, the air conditioner carries out the defrosting operation. When the defrosting operation is carried out, in this embodiment, the air conditioner carries out the hot gas bypass defrosting operation when the frosting amount is relatively small (when the ratio is approximately 20 to 80%) and carries out the reverse cycle defrosting operation when the frosting amount is large (when the ratio is 80% or more).

In the air conditioner configured as explained above, during the heating operation, the refrigerant flows and circulates as indicated by solid line arrows. That is, during the heating operation, the refrigerant having high temperature and high pressure discharged from the compressor 7 flows into the indoor heat exchanger 16 through the four-way valve 4 switched to the heating side. The air sucked by the indoor machine 2 and the refrigerant flowing in the heat transfer pipe perform heat exchange, whereby the refrigerant condenses and changes to a liquid refrigerant. At this point, heat radiated from the refrigerant is given to the air on the indoor side, whereby heating is performed. The liquid refrigerant flowing out from the indoor heat exchanger 16 expands when flowing through the indoor expansion valve 17 and the outdoor expansion valve 6 and flows into the outdoor heat exchanger 5 in a low-temperature and low-pressure state. The outdoor heat exchanger 5 functions as an evaporator. The refrigerant evaporates and changes to a gas refrigerant by performing heat exchange with the air outside the room (the outdoor air) sucked by the outdoor machine 1. Therefore, the refrigerant is sucked by the compressor 3 again through the four-way valve 4.

During the hot gas bypass defrosting operation, a part of the high-temperature refrigerant discharged from the compressor 3 flows to the hot gas bypass circuit 9 as indicated by arrows of alternate long and two short dashes lines. The gas refrigerant having high temperature is fed to the outdoor heat exchanger 5 to defrost the outdoor heat exchanger 5.

During the reverse cycle defrosting operation and during the cooling operation, the refrigerant circulates as indicated by arrows of dotted lines. That is, the gas refrigerant having high temperature and high pressure discharged from the compressor 3 flows to the outdoor heat exchanger 5 and condenses. During the reverse cycle defrosting operation, the gas refrigerant heats and defrosts the outdoor heat exchanger 5 with condensation heat during the condensation. Thereafter, the refrigerant flows to the indoor heat exchanger 16 side and evaporates, changes to the gas refrigerant, and circulates to return to the compressor 3 again.

Operation for controlling, in the air conditioner in this embodiment, when frost is deposited on the outdoor heat exchanger 3 by the heating operation, the defrosting operation for removing the frost is explained according to FIG. 2 with reference to FIG. 1 as well.

FIG. 2 is a flowchart showing operation for controlling the defrosting operation in this embodiment. The operation is explained below according to the flowchart.

First, the air conditioner is started (step S0) and the heating operation is started (step S1). Thereafter, in step S2, the air conditioner detects a frosting amount on the outdoor heat exchanger 5 due to the heating operation with, for example, means for detecting the temperature of the outdoor heat exchanger 5. That is, in step S2, frosting amount detection is performed by means for, for example, calculating a correlation between temperature and a frosting amount of the outdoor heat exchanger 5 in advance through an experiment or the like and estimating, on the basis of the correlation, a frosting amount from temperature detected by the heat exchanger temperature thermistor 15.

Subsequently, the air conditioner shifts to step S3, the air conditioner determines whether the detected frosting amount is equal to or smaller than a predetermined set temperature. In step S3, when the detected frosting amount is equal to or smaller than the set value (in the case of YES), the air conditioner determines that the frosting amount is small, shifts to step S4, and performs the defrosting operation in the hot gas bypass system, that is, the hot gas bypass defrosting operation. If the hot gas bypass defrosting operation ends (step S5), the air conditioner returns to S1 and returns to the heating operation.

On the other hand, when the detected frosting amount exceeds the predetermined set value in step S3 (in the case of NO), the air conditioner determines that the frosting amount is large, shifts to step S6, and performs the defrosting operation in the reverse cycle system, that is, the reverse cycle defrosting operation. If the reverse cycle defrosting operation ends (step S7), the air conditioner returns to step S1 and returns to the heating operation.

In this way, in this embodiment, in starting the defrosting operation, the air conditioner detects (estimates) a frosting amount on the outdoor heat exchanger 5, according to the frosting amount, selects and carries out the hot gas bypass defrosting operation when the frosting amount is small and selects and carries out the reverse cycle defrosting operation when the frosting amount is larger than the predetermined set value. Therefore, it is possible to suppress a decrease in the total heating capacity during the air conditioner operation by the defrosting operation.

That is, in this embodiment, the defrosting system is selected according to the frosting amount such that time for defrosting, which is a total of times required for the defrosting operation and the heating operation startup after the defrosting operation, decreases.

Explaining more in detail, in the reverse cycle defrosting operation, although the defrosting operation time can be reduced, the time required for the heating startup after the defrosting operation is long. Therefore, the reverse cycle defrosting operation is carried out when the frosting amount is large. When the frosting amount is small, the hot gas bypass defrosting operation is carried out. In the hot gas bypass defrosting operation, although the defrosting operation time is long, a room temperature rise after the defrosting operation can be accelerated and the heating operation startup is fast. Therefore, when the frosting amount is small, the times required for the defrosting operation and the heating operation startup after the defrosting operation can be reduced to be shorter than when the reverse cycle defrosting operation is selected.

Note that, in step S2, if the air conditioner continues the frosting amount detection after the heating start and proceeds to step S3 when the detected frosting amount exceeds a reference value or the heating operation time exceeds a fixed time, it is possible to prevent the defrosting operation from being frequently repeated. The frosting amount detection in step S2 may be performed in every fixed time. Further, in order to carry out the defrosting operation when the frosting amount is small, it is also possible to set the set value in step S3 in two stages and, when frosting is absent or extremely little, return to step S1 without performing the defrosting operation and, only in the case of a frosting amount in which the defrosting operation should be performed, select step S4 or S6 to perform the defrosting operation.

Concerning means for detecting (estimating) a frosting amount, besides means for, for example, detecting the temperature of the outdoor heat exchanger 5, it is also possible to estimate the frosting amount by detecting a compressor suction pressure closely related to an outdoor heat exchanger temperature. The frosting amount may be estimated according to a change in electric power consumed by the blower (the outdoor blower) 13 of the outdoor heat exchanger (the heat source side heat exchanger). Further, it is also possible to directly detect the frosting amount.

Second Embodiment

Figure 3:
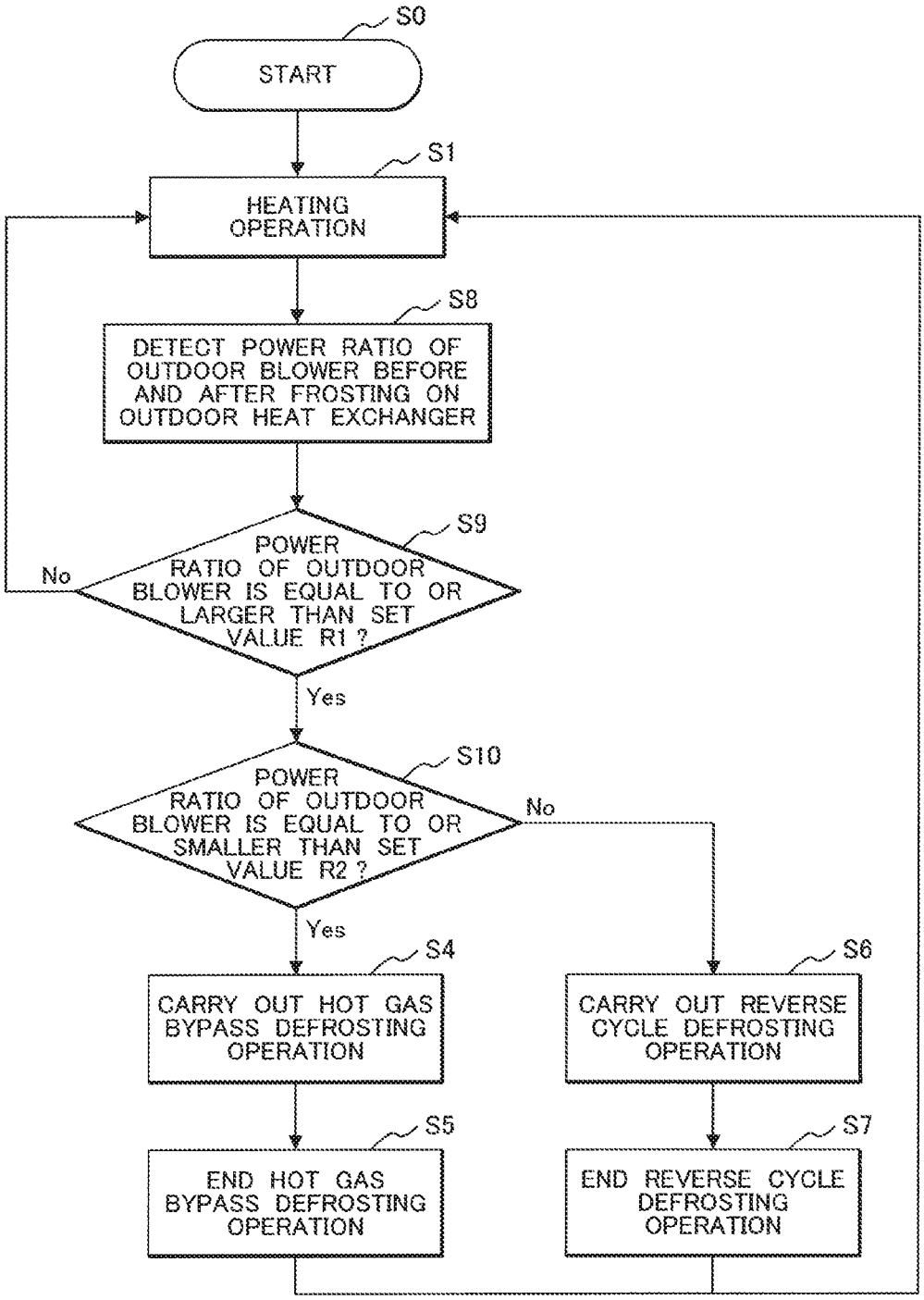
FIG. 3 is a flowchart showing operation for controlling defrosting operation in a second embodiment.

A second embodiment of the present invention is explained with reference to FIG. 3. FIG. 3 is a flowchart showing operation for controlling defrosting operation in the second embodiment. Note that the configuration of an air conditioner is the same as the configuration shown in FIG. 1. The second embodiment is explained with reference to FIG. 1 as well.

In FIG. 3, steps S0, S1, and S4 to S7 are the same as the steps shown in FIG. 2. Therefore, explanation of the steps is omitted.

The second embodiment describes an example in which steps S2 and S3 in FIG. 2 are made more specific. In step S8 in FIG. 3, the detection of a frosting amount in step S2 in FIG. 2 is performed by calculating a power ratio of the outdoor blower 13 before and after frosting on the outdoor heat exchanger 5 and using the power ratio.

Power (power consumption) of the outdoor blower 13 can be calculated from the following expression by detecting an electric current flowing to a motor of the outdoor blower 13. Note that a voltage and a power factor are fixed.

$$\text{Power}=\text{voltage}\times\text{current}\times\text{power factor}$$

Therefore, it is possible to calculate a power ratio "P2/P1" by calculating electric power P1 of the outdoor blower 13 before frosting on the outdoor heat exchanger 5 and electric power P2 of the outdoor blower 13 after the frosting.

A relation between a power ratio and a frosting amount is calculated in advance by an experiment or the like. When the number of revolutions of the outdoor blower 13 is fixed, electric power (power consumption) before frosting is small because ventilation resistance of the outdoor heat exchanger 5 is small. However, when frosting proceeds, since the ventilation resistance gradually increases, the power consumption increases. Therefore, it is possible to estimate a frosting amount by calculating a power ratio of the outdoor blower 13 before and after frosting of the outdoor heat exchanger 5.

Subsequently, in step S9, the air conditioner determines on the basis of the power ratio calculated in step S8 whether the power ratio in the outdoor blower 13 is equal to or larger than a predetermined set value R1. The set value R1 is a value of a power ratio corresponding to a case in which the ratio of the area of frosting (the frosting area) is, for example, approximately 20 to 30% with respect to the heat transfer area in the outdoor heat exchanger 5.

When the power ratio is smaller than the set value R1 in the determination in step S9 (in the case of NO), the air conditioner returns to step S1 and continues the heating operation. When the power ratio is equal to or larger than the set value R1 (in the case of YES), the air conditioner shifts to step S10.

In step S10, the air conditioner determines on the basis of the power ratio calculated in step S8 whether the power ratio in the outdoor blower 13 is equal to or larger than a predetermined set value R2. The set value R2 is a value of a power ratio corresponding to a case in which the ratio of the area of frosting (the frosting area) is, for example, approximately 80% with respect to the heat transfer area in the outdoor heat exchanger 5. Therefore, the set value R2 is a value larger than the set value R1.

When the power ratio is equal to or smaller than the set value R2 in the determination in step S10 (in the case of YES), the air conditioner determines that the frosting amount is relatively small (the ratio of the frosting area is approximately 20 to 80%), shifts to step S4, and carries out the hot gas bypass defrosting operation.

When the power ratio is larger than the set value R2 in the determination of step S10 (in the case of NO), the air conditioner determines that the frosting amount is large (the ratio of the frosting area is higher than approximately 80%). In this case, the air conditioner shifts to step S6 and carries out the reverse cycle defrosting operation.

If the defrosting operation in step S4 or step S6 ends (step S5 or S7), the air conditioner returns to the heating operation in step S1.

In this way, according to the second embodiment, the air conditioner estimates the frosting amount according to the power ratio of the outdoor blower before and after frosting of the outdoor heat exchanger 5 and selects and carries out the hot gas bypass defrosting operation when the frosting amount is small and selects and carries out the reverse cycle defrosting operation when the frosting amount is larger than the predetermined set value. Therefore, it is possible to reduce time for defrosting, which is a total of times required for defrosting operation and heating operation startup after the defrosting operation, and suppress a decrease in a total heating capacity during air conditioner operation.

Note that, in the second embodiment, the power ratio is calculated and the frosting amount is estimated. However, even if a current ratio is used instead of the power ratio, it is possible to estimate the frosting amount in the same manner. That is, if values of electric currents flowing to the motor of the outdoor blower 13 before and after frosting of the outdoor heat exchanger 5 are detected, a ratio (a current ratio) of the current values before and after the frosting is calculated, and a relation between the current ratio and the frosting amount is calculated in advance by an experiment or the like, it is also possible to estimate the frosting amount.

Third Embodiment

Figure 4:
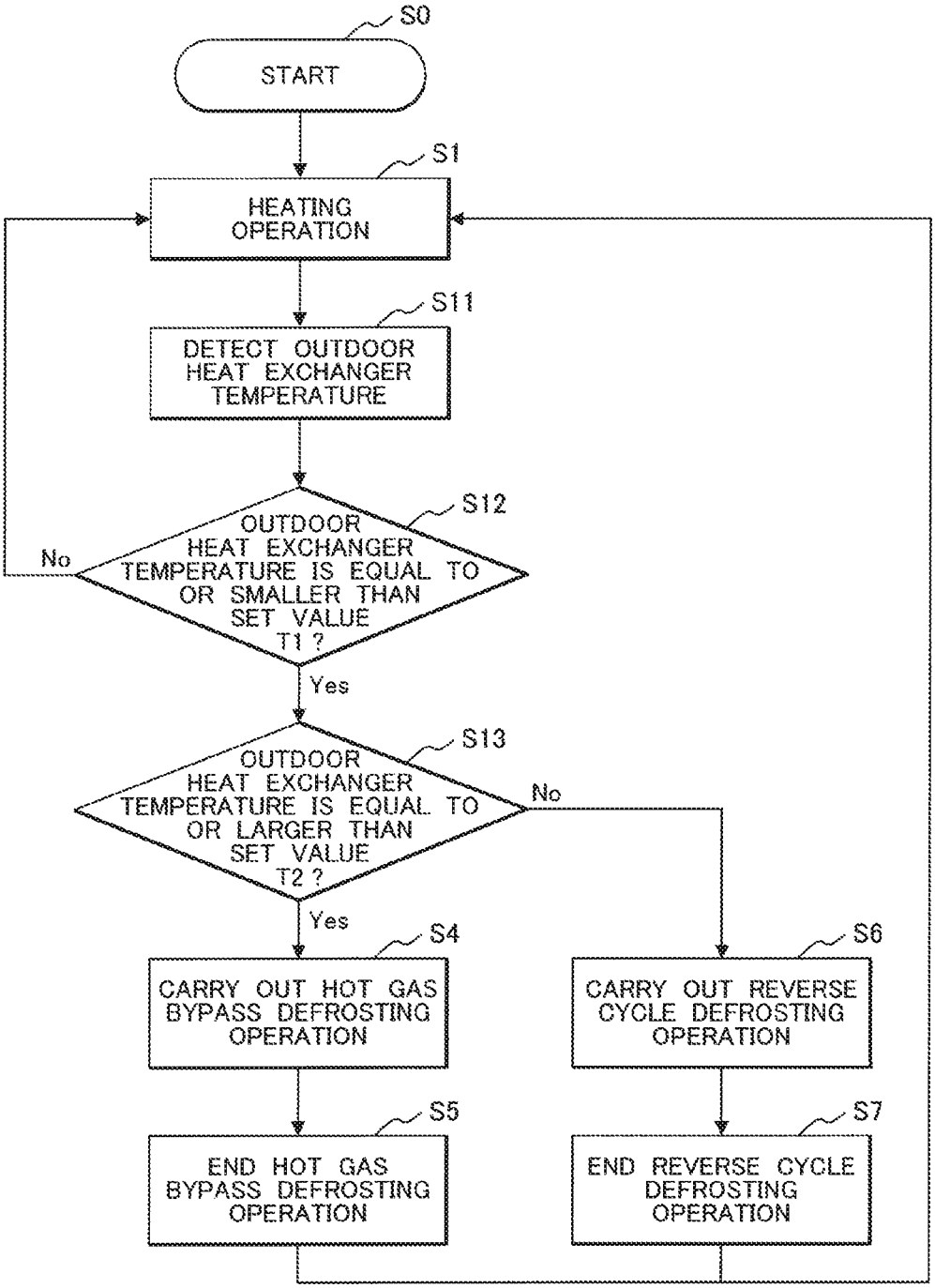
FIG. 4 is a flowchart showing operation for controlling defrosting operation in a third embodiment.

A third embodiment of the present invention is explained with reference to FIG. 4. FIG. 4 is a flowchart showing operation for controlling defrosting operation in the third embodiment. Note that, in this embodiment as well, the configuration of an air conditioner is the same as the configuration shown in FIG. 1. The third embodiment is explained with reference to FIG. 1 as well.

In FIG. 4, in this embodiment as well, steps S0, S1, and S4 to S7 are the same as the steps shown in FIG. 2. Therefore, explanation of the steps is omitted.

The third embodiment also describes an example in which steps S2 and S3 in FIG. 2 are made more specific. In step S11 in FIG. 4, the detection of a frosting amount in step S2 in FIG. 2 is performed by detecting the temperature of the outdoor heat exchanger 5 with the heat exchanger temperature thermistor 15 and using the temperature.

That is, when frost is deposited on the outdoor heat exchanger 5, since heat exchange efficiency is deteriorated, the number of revolutions of the compressor 3 increases. As a result, evaporation pressure in the outdoor heat exchanger 5 drops and the temperature of the outdoor heat exchanger 5 also drops according to the drop of the evaporation pressure. Therefore, if a relation between the temperature of the outdoor heat exchanger 5 and the frosting amount is calculated in advance by an experiment or the like, it is possible to estimate a frosting amount on the outdoor heat exchanger 5 by detecting the temperature of the outdoor heat exchanger 5.

Subsequently, in step S12, the air conditioner determines on the basis of the temperature of the outdoor heat exchanger 5 detected by the heat exchanger temperature thermistor 15 in step S11 whether the temperature of the outdoor heat exchanger 5 is equal to or smaller than a predetermined set value T1. The set value T1 is a value of temperature corresponding to a case in which the ratio of the area of frosting (the frosting area) is, for example, approximately 20 to 30% with respect to the heat transfer area in the outdoor heat exchanger 5.

When a value of the temperature is larger than the set value T1 in the determination in step S12 (in the case of NO), the air conditioner returns to step S1 and continues the heating operation. When the value of the temperature is equal to or smaller than the set value T1 (in the case of YES), the air conditioner shifts to step S13.

In step S13, the air conditioner determines on the basis of the temperature of the outdoor heat exchanger 5 detected in step S11 whether the temperature of the outdoor heat exchanger 5 is equal to or larger than a predetermined set value T2. The set value T2 is a value of temperature corresponding to a case in which the ratio of the area of frosting (the frosting area) is, for example, approximately 80% with respect to the heat transfer area in the outdoor heat exchanger 5. Therefore, the set value T2 is a value smaller than the set value T1.

When the value of the temperature is larger than the set value T2 in the determination in step S13 (in the case of YES), the air conditioner determines that the frosting amount is relatively small (the ratio of the frosting area is approximately 20 to 80%), shifts to step S4, and carries out the hot gas bypass defrosting operation.

When the value of the temperature is smaller than the set value T2 in the determination in step S13 (in the case of NO), the air conditioner determines that the frosting amount is large (the ratio of the frosting area is equal to or larger than approximately 80%). In this case, the air conditioner shifts to step S6 and carries out the reverse cycle defrosting operation.

If the defrosting operation in step S4 or step S6 ends (step S5 or S7), the air conditioner returns to the heating operation in step S1 again.

In this way, according to the third embodiment, the air conditioner estimates the frosting amount according to the temperature of the outdoor heat exchanger 5 detected by the heat exchanger temperature thermistor 15 and selects and carries out the hot gas bypass defrosting operation when the frosting amount is small and selects and carries out the reverse cycle defrosting operation when the frosting amount is larger than the predetermined set value. Therefore, as in the first and second embodiments, it is possible to reduce time for defrosting, which is a total of times required for defrosting operation and heating operation startup after the defrosting operation, and suppress a decrease in a total heating capacity during air conditioner operation.

Note that, in the third embodiment, the temperature (evaporation temperature) of the outdoor heat exchanger 5 is detected and the frosting amount is estimated. However, even if pressure (evaporation pressure) on a compressor suction side, that is, a lower pressure side from the outdoor expansion valve 6 to the suction side of the compressor 3 is detected instead of the temperature of the outdoor heat exchanger 5, it is possible to estimate the frosting amount in the same manner. That is, if a pressure sensor is provided on the suction side of the compressor 3 to detect low-pressure side pressure and a relation between the low-pressure side pressure and the frosting amount is calculated in advance by an experiment or the like, it is also possible to estimate the frosting amount.

Fourth Embodiment

A fourth embodiment of the present invention is explained with reference to FIGS. 5 to 7. In this embodiment as well, the configuration of an air conditioner is the same as the configuration shown in FIG. 1. The fourth embodiment is explained with reference to FIG. 1 as well.

Figure 5:
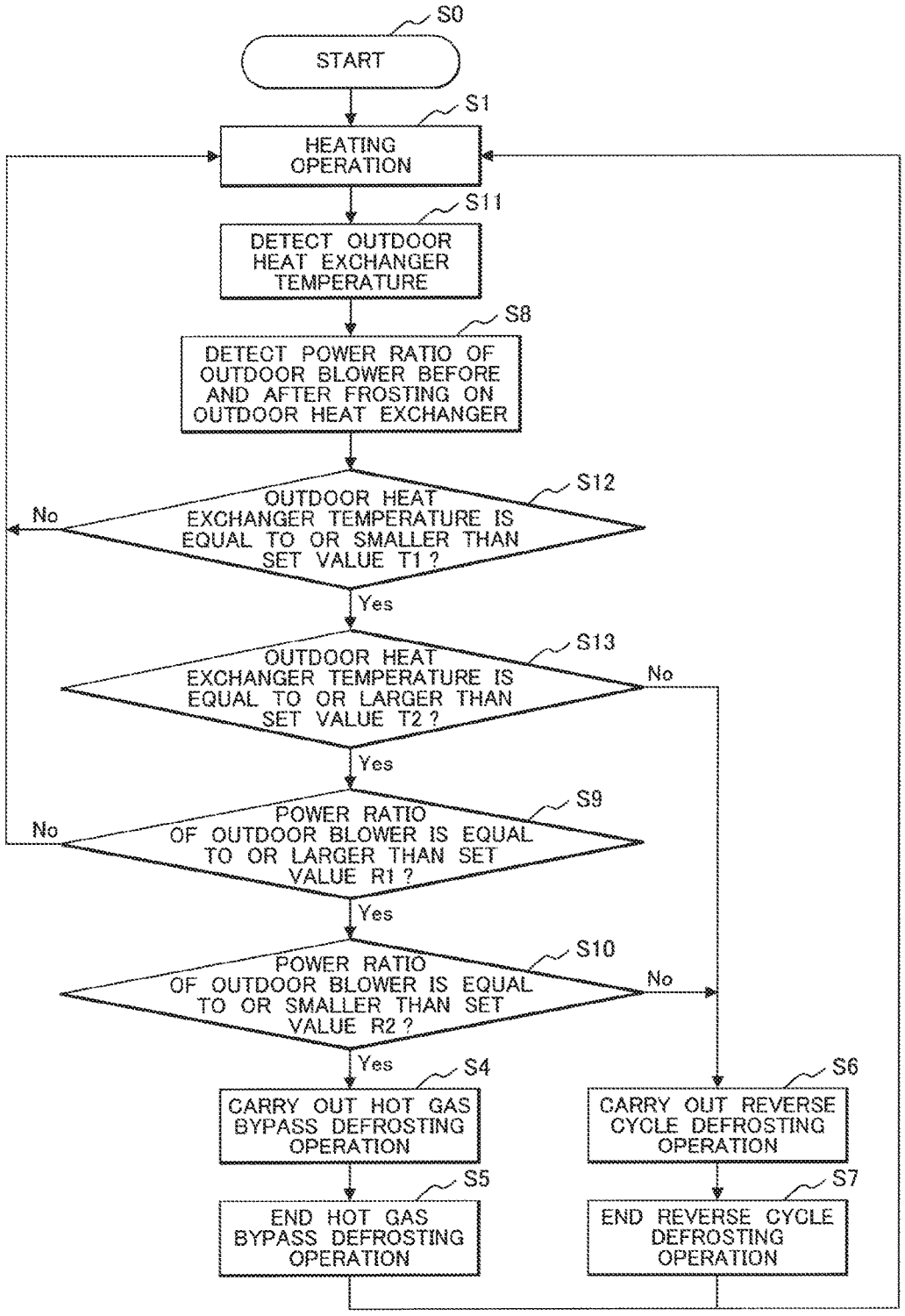
FIG. 5 is a flowchart showing operation for controlling defrosting operation in a fourth embodiment.

FIG. 5 is a flowchart showing operation for controlling defrosting operation in the fourth embodiment.

In FIG. 5, in this embodiment as well, steps S0, S1, and S4 to S7 are the same as the steps shown in FIG. 2. Therefore, explanation of the steps is omitted.

In the fourth embodiment, steps S11, S12, and S13 shown in FIG. 5 are the same as steps S11, S12, and S13 in the third embodiment shown in FIG. 4. Further, steps S8, S9, and S10 in the fourth embodiment are the same as steps S8, S9, and S10 in the second embodiment shown in FIG. 3.

The fourth embodiment also describes an example in which steps S2 and S3 in FIG. 2 are made more specific. That is, in step S11 in FIG. 5, the detection of a frosting amount in step S2 in FIG. 2 is performed by detecting the temperature of the outdoor heat exchanger 5 in the outdoor heat exchanger 5 with the heat exchanger temperature thermistor 15. Further, in step S8 in FIG. 5, a power ratio of the outdoor blower 13 before and after frosting on the outdoor heat exchanger 5 is calculated and the detection of a frosting amount is performed using the power ratio as well. In this way, in the fourth embodiment, the frost amount detection in step S2 is performed using both of the temperature of the outdoor heat exchanger 5 and the power ratio of the outdoor air blower before and after frosting on the outdoor heat exchanger 5.

In this embodiment, first, in step S11, as in the third embodiment, the air conditioner detects the temperature of the outdoor heat exchanger 5 with the heat exchanger temperature thermistor 15. Further, in step S8, as in the second embodiment, the air conditioner calculates a power ratio of the outdoor blower 13 before and after frosting on the outdoor heat exchanger 5.

Subsequently, in steps S12 and S13, the air conditioner performs operation same as the operation in the third embodiment.

That is, in step S12, the air conditioner determines on the basis of the temperature of the outdoor heat exchanger 5 detected by the heat exchanger temperature thermistor 15 in step S11 whether the temperature of the outdoor heat exchanger 5 is equal to or smaller than the predetermined set value T1. When a value of the temperature is larger than the set value T1 (in the case of NO) in the determination in step S12, the air conditioner returns to step S1 and continues the heating operation. When the value of the temperature is equal to or smaller than the set value T1 (in the case of YES), the air conditioner shifts to step S13.

In step S13, the air conditioner determines on the basis of the temperature of the outdoor heat exchanger 5 detected in step S11 whether the temperature of the outdoor heat exchanger 5 is equal to or larger than the predetermined set value T2. When the value of the temperature is smaller than the set value T2 in the determination of step S13 (in the case of NO), the air conditioner determines that the frosting amount is large. In this case, the air conditioner shifts to step S6 and carries out the reverse cycle defrosting operation.

In this embodiment, when the value of the temperature is larger than the set value T2 in the determination in step S13 (in the case of YES), the air conditioner shifts to step S9.

In step S9, the air conditioner determines on the basis of the power ratio calculated in step S8 whether the power ratio in the outdoor blower 13 is equal to or larger than the predetermined set value R1. When the power ratio is smaller than the set value R1 in the determination in step S9 (in the case of NO), in this embodiment, even when the temperature of the outdoor heat exchanger 5 is between the set values T1 and T2, the air conditioner determines that the frosting amount has not reached a frosting amount in which the defrosting operation should be performed. The air conditioner returns to step S1 and continues the heating operation.

When the power ratio is equal to or larger than the set value R1 in step S9 (in the case of YES), the air conditioner shifts to step S10.

In step S10, the air conditioner determines on the basis of the power ratio calculated in step S8 whether the power ratio in the outdoor blower 13 is equal to or larger than the predetermined set value R2. When the power ratio in the determination is equal to or smaller than the set value R2 in step S9 (in the case of YES), the air conditioner determines that the frosting amount is relatively small, shifts to step S4, and carries out the hot gas bypass defrosting operation. When the power ratio is larger than the set value R2 in the determination in step S10 (in the case of NO), the air conditioner determines that the frosting amount is large. In this case, the air conditioner shifts to step S6 and carries out the reverse cycle defrosting operation.

If the defrosting operation in step S4 or step S6 ends (step S5 or S7), the air conditioner returns to the heating operation in step S1 again.

Figure 6:
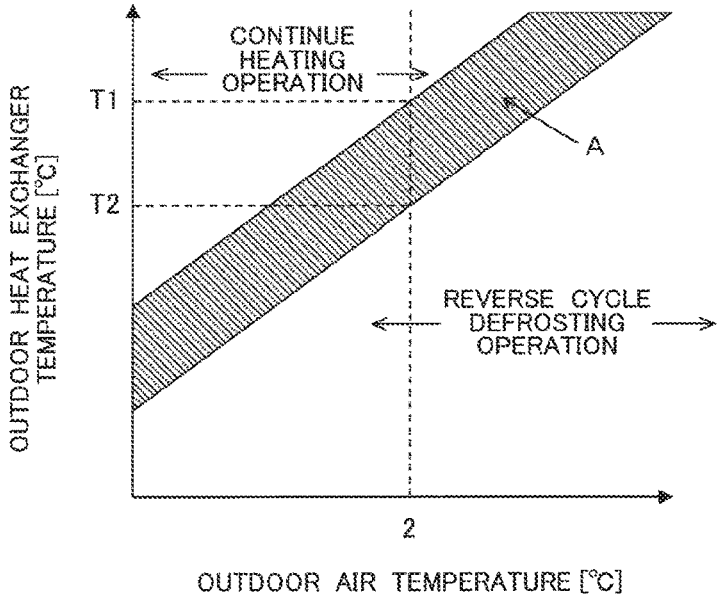
FIG. 6 is a graph for explaining a method of determining a set value of an outdoor heat exchanger temperature with respect to an outdoor air temperature.

FIG. 6 is a graph for explaining a method of determining the set values T1 and T2 of the outdoor heat exchanger temperature with respect to outdoor air temperature. In FIG. 6, the horizontal axis indicates the outdoor air temperature and the vertical axis indicates the temperature of the outdoor heat exchanger 5. The outdoor air temperature can be detected by the outdoor air temperature thermistor 14 shown in FIG. 1. The temperature of the outdoor heat exchanger 5 can be detected by the heat exchanger temperature thermistor 15.

A portion of a range A indicated by hatching is a range for determining the set values T1 and T2 with respect to the outdoor air temperature. For example, when the outdoor air temperature is 2° C., as shown in FIG. 6, an upper limit temperature of a portion where a broken line indicating 2° C. and the range A cross is determined as the set value T1. A lower limit temperature of the portion where the broken line indicating 2° C. and the range A cross is determined as the set value T2.

When the temperature of the outdoor heat exchanger 5 is higher than the range A, the defrosting operation is not performed and the heating operation is continued. When the temperature of the outdoor heat exchanger 5 is lower than the range A, the reverse cycle defrosting operation is carried out. When the temperature of the outdoor heat exchanger 5 is within the range A, that is, between the set values T1 and T2, depending on determination results in steps S9 and S10, it is highly likely that the hot gas bypass defrosting operation is performed. Note that, in the case of the third embodiment, the hot gas bypass defrosting operation is carried out if the temperature of the outdoor heat exchanger 5 is within the range A.

As shown in FIG. 6, the set values T1 and T2 of the outdoor heat exchanger temperature for determining the frosting amount are changed according to an outdoor air temperature. When the outdoor air temperature is lower than 2° C., the outdoor heat exchanger temperature is a value lower than the set values T1 and T2. When the outdoor air temperature is higher than 2° C., the outdoor heat exchanger temperature is a value higher than the set values T1 and T2. The set values T1 and T2 are determined on the basis of FIG. 6. The determination in steps S12 and S13 is carried out using the set values.

Figure 7:
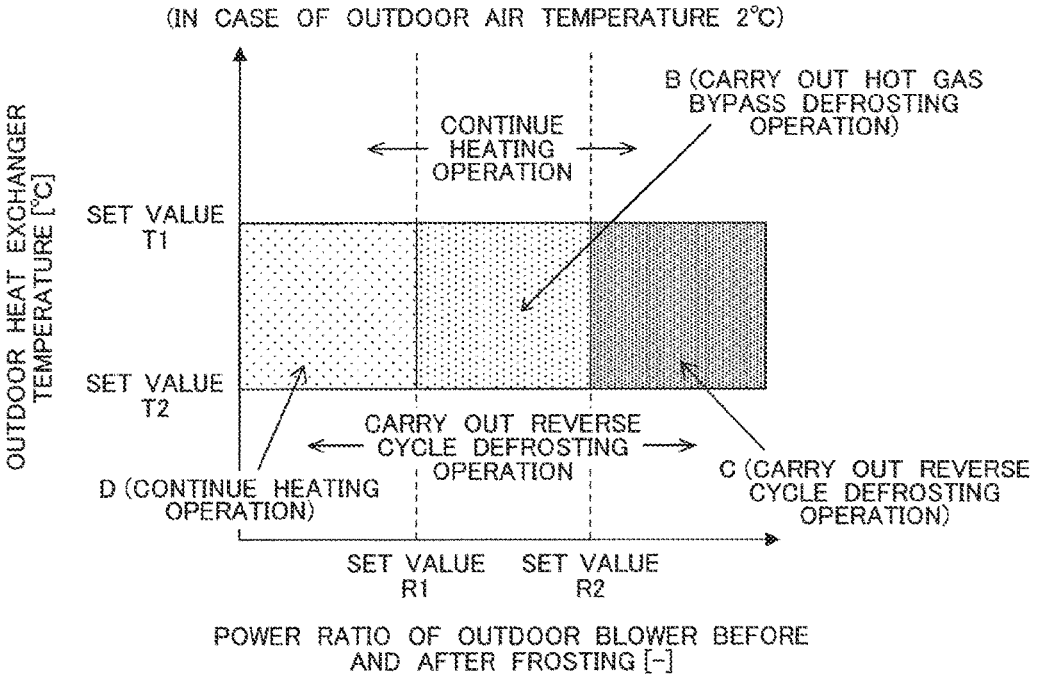
FIG. 7 is a diagram for explaining selection of a defrosting system based on a power ratio in an outdoor blower before and after frosting and the outdoor heat exchanger temperature.

FIG. 7 is a diagram for explaining selection of a defrosting system based on a power ratio in the outdoor blower 13 before and after frosting and the temperature of outdoor heat exchanger 5. The horizontal axis indicates a power ratio in the outdoor blower 13 before and after frosting and the vertical axis indicates the temperature of the outdoor heat exchanger 5 detected by the heat exchanger temperature thermistor 15. When the operation of the flowchart indicating the operation for controlling the defrosting operation shown in FIG. 5 is executed, an appropriate defrosting system is selected as shown in FIG. 7 on the basis of the set values T1, T2, R1, and R2 described above. The defrosting operation is carried out or the defrosting operation is not carried out and the heating operation is continued.

That is, when the power ratio and the outdoor heat exchanger temperature are present in a region B surrounded by the set values T1, T2, R1, and R2, the hot gas bypass defrosting operation is carried out. When the outdoor heat exchanger temperature is between the set values T1 and T2 and the power ratio is equal to or larger than the set value R2 (a region C) and, when the outdoor heat exchanger temperature is equal to or smaller than the set value T2, the reverse cycle defrosting operation is carried out. Further, when the outdoor heat exchanger temperature is between the set values T1 and T2 and the power ratio is equal to or smaller than the set value R1 (a region D) and when the outdoor heat exchanger temperature is equal to or larger than the set value T1, the defrosting operation is not performed and the heating operation is continued.

In this way, according to the fourth embodiment, the frosting amount is estimated according to the temperature of the outdoor heat exchanger 5 detected by the heat exchanger temperature thermistor 15 and the power ratio of the outdoor blower before and after frosting on the outdoor heat exchanger 5. Therefore, it is possible to accurately estimate that frost is surely deposited on the outdoor heat exchanger 5 and accurately estimate the frosting amount. Therefore, it is possible to prevent erroneous detection of the frosting amount, avoid the defrosting operation when the frosting amount is extremely small, and accurately select according to the more accurately estimated frosting amount whether the hot gas bypass defrosting operation is performed or the reverse cycle defrosting operation is performed. Therefore, it is possible to reduce time for defrosting, which is a total of times required for the defrosting operation and the heating operation startup after the defrosting operation, and suppress a decrease in a total heating capacity during the air conditioner operation.

Note that the present invention is not limited to the embodiments explained above. Various modifications are included in the present invention. For example, steps S11 and S8 in FIG. 5 may be executed in the opposite order or may be simultaneously executed. The execution order of steps S12 and S13 and steps S9 and S10 may be changed to execute steps S12 and S13 after carrying out steps S9 and S10.

The embodiments are explained in detail in order to clearly explain the present invention and are not always limited to embodiments including all the explained components. Further, a part of the components of a certain embodiment can be replaced with the components of another embodiment. The components of another embodiment can be added to the components of a certain embodiment. Other components can be added to, deleted from, and replaced with a part of the components of the embodiments.

Programs for realizing the functions and information such as the set values and the set times can be stored in recording devices such as a memory, a hard disk, and an SSD (Solid State Drive) or recording media such as an IC card, an SD card, and a DVD.

REFERENCE SIGNS LIST

1: outdoor machine
2: indoor machine
3: compressor
4: four-way valve
5: outdoor heat exchanger (heat source side heat exchanger)
5*a*: gas header
5*b*: liquid header
6: outdoor expansion valve (expansion valve)
7: outdoor machine side gas prevention valve
8: outdoor machine side liquid prevention valve
9: hot gas bypass circuit
10: hot gas bypass on-off valve (on-off valve)
11, 12: refrigerant pipe
13: outdoor blower
14: outdoor air temperature thermistor
15: heat exchanger temperature thermistor
16: indoor heat exchanger (use side heat exchanger)
16*a*: gas header
16*b*: liquid header
17: indoor expansion valve (expansion valve)
18: indoor machine side gas prevention valve
19: indoor machine side liquid prevention valve

The invention claimed is:

1. An air conditioner in which a compressor, a four-way valve, a use side heat exchanger, an expansion valve, and a heat source side heat exchanger are connected to configure a freezing cycle, the air conditioner comprising:

an outdoor blower for blowing outdoor air to the heat source side heat exchanger;

a hot gas bypass circuit that connects a discharge side of the compressor and a portion of a connection between the heat source side heat exchanger and the expansion valve;

an on-off valve that opens and closes a channel of the hot gas bypass circuit; and a controller configured to: select one of hot gas bypass defrosting operation and reverse cycle defrosting operation based on a power ratio, which is a ratio of electric power of the outdoor blower before frost is formed on the heat source side heat exchanger and electric power of the outdoor blower after frost is formed on the heat source side heat exchanger, upon selection of the hot gas bypass defrosting operation, open the on-off valve of the hot gas bypass circuit such that a part of a refrigerant discharged from the compressor is supplied to the heat source side heat exchanger via the hot gas bypass circuit and, upon selection of the reverse cycle defrosting operation, switch the four-way valve such that the refrigerant discharged from the compressor is supplied to the heat source side heat exchanger after passing through the four-way valve.

2. The air conditioner according to claim 1, further comprising a heat exchanger temperature thermistor that detects a temperature of the heat source side heat exchanger, wherein the controller is configured to select one of the hot gas bypass defrosting operation and the reverse cycle defrosting operation based on a temperature of the heat source side heat exchanger detected by the heat exchanger temperature thermistor.

3. The air conditioner according to claim 1, further comprising:

a heat exchanger temperature thermistor that detects temperature of the heat source side heat exchanger; and wherein the controller is configured to select one of the hot gas bypass defrosting operation and the reverse cycle defrosting operation based on a temperature of the heat source side heat exchanger detected by the heat exchanger temperature thermistor and the power ratio.

4. The air conditioner according to claim 1, further comprising:

a heat exchanger temperature thermistor that detects temperature of the heat source side heat exchanger; and wherein the controller is configured to select one of the hot gas bypass defrosting operation and the reverse cycle defrosting operation based on a temperature of the heat source side heat exchanger detected by the heat exchanger temperature thermistor and the current ratio.

5. An air conditioner in which a compressor, a four-way valve, a use side heat exchanger, an expansion valve, and a heat source side heat exchanger are connected to configure a freezing cycle, the air conditioner comprising:

an outdoor blower for blowing outdoor air to the heat source side heat exchanger;

a hot gas bypass circuit that connects a discharge side of the compressor and a portion of a connection between the heat source side heat exchanger and the expansion valve;

an on-off valve that opens and closes a channel of the hot gas bypass circuit; and a controller configured to:

select one of hot gas bypass defrosting operation and reverse cycle defrosting operation based on a current ratio, which is a ratio of an electric current flowing to a motor of the outdoor blower before frost is formed on the heat source side heat exchanger and an electric current flowing to the motor of the outdoor blower after frost is formed on the heat source side heat exchanger, upon selection of the hot gas bypass defrosting operation, open the on-off valve of the hot gas bypass circuit such that a part of a refrigerant discharged from the compressor is supplied to the heat source side heat exchanger via the hot gas bypass circuit and, upon selection of the reverse cycle defrosting operation, switch the four-way valve such that the refrigerant discharged from the compressor is supplied to the heat source side heat exchanger after passing through the four-way valve.

6. The air conditioner according to claim 5, further comprising a heat exchanger temperature thermistor that detects a temperature of the heat source side heat exchanger, wherein the controller is configured to select one of the hot gas bypass defrosting operation and the reverse cycle defrosting operation based on a temperature of the heat source side heat exchanger detected by the heat exchanger temperature thermistor.

* * * * *